United States Patent [19]

Kameda

[11] 4,058,293

[45] Nov. 15, 1977

[54] TWO-MASTED LIFTING APPARATUS

[76] Inventor: Tamotsu Kameda, 2594-5 Ohmiya, Fujinomiya, Shizuoka, Japan

[21] Appl. No.: 731,364

[22] Filed: Oct. 12, 1976

[30] Foreign Application Priority Data

Apr. 27, 1976 Japan ..... 51-47177

[51] Int. Cl.[2] ..... B66F 7/26

[52] U.S. Cl. ..... 254/89 H

[58] Field of Search ..... 254/47, 89 R, 89 H; 187/8.41, 8.74, 8.75, 9

[56] References Cited

U.S. PATENT DOCUMENTS

| | | | |
|---|---|---|---|
| 3,830,466 | 8/1974 | Rusmussen et al. | 254/47 |
| 3,865,346 | 2/1975 | Shirk | 254/89 R |

FOREIGN PATENT DOCUMENTS

| | | | |
|---|---|---|---|
| 2,064,243 | 1/1973 | Germany | 254/89 R |

*Primary Examiner*—Robert C. Watson

[57] ABSTRACT

A two-masted lifting apparatus for lifting a weighty object such as a vehicle or the like to a certain height with its original posture maintained and then inclining the lifted object at a desired angle so that inspecting, cleaning or repairing works upon the underside of the object are carried out easily and safely. The two-masted lifting apparatus comprises two opposing upright masts on each of which a carriage having means for supporting the object is slidably mounted. Both carriages are independently driven by separate driving means and are connected to each other by a chain so that the actuation of one of the driving means effects synchronous lifting of both carriages while the actuation of the other effects only the lifting of one of them. The means for supporting the object is of the telescopic structure and is horizontally movable toward or away from each mast.

12 Claims, 3 Drawing Figures

TWO-MASTED LIFTING APPARATUS

The present invention generally relates to a two-masted lifting apparatus for lifting a weighty object such as a vehicle or the like to a certain height, and more particularly relates to a two-masted lifting apparatus of the kind in which it is possible to incline at a desired angle a vehicle or the like which has been lifted up to a certain height; whereby the inspecting, repairing or cleaning works upon the underside of the vehicle or the like can be carried out easily and safely.

Although there have heretofore been proposed various types of two-masted lifting apparatus, most of them are not provided with such a mechanism that is capable of inclining a vehicle or the like which has been horizontally supported at a certain height. This is primarily because great risks such as slipping accidents are very likely to occur when inclining the weighty objects lifted up above the ground.

It is therefore a prime object of the present invention to provide a two-masted lifting apparatus which is capable of not only lifting a vehicle or the like horizontally but also inclining it at a desired angle in safety.

According to one aspect of this invention, a carriage having at least two supporting means for supporting a vehicle or the like is slidably mounted on each of two opposing upright masts and an independent driving means is disposed within each of the two masts. Both of the carriages are associatively connected to each other by a chain so that when one of the two driving means is actuated both carriages can move up or down along the respective masts in synchronism with each other. On the other hand, the other driving means is adapted to administer only the sliding movement of one of the two carriages along the mast.

Hence, it will readily be understood that one of the two driving means serves to horizontally lift a vehicle or the like to a certain height while the other driving means serves to incline it at a desired angle.

According to another aspect of the invention, each of the supporting means for supporting a vehicle or the like is horizontally movable toward or away from each mast. In accordance with one embodiment of the invention, each supporting means comprises a sleeve mounted on the carriage, an arm slidably inserted within the sleeve and a step rotatably mounted on the arm. The two opposing steps are connected with each other by a chain so that, when the driving means for inclining the vehicle is actuated, the arms slidably inserted within sleeves are dragged out of the sleeves by the chain; thereby keeping the distance constant between the two opposing steps on which the vehicle is supported. Thus, it becomes possible to incline in much safety the vehicle which has been supported horizontally by the steps.

Figure 1:
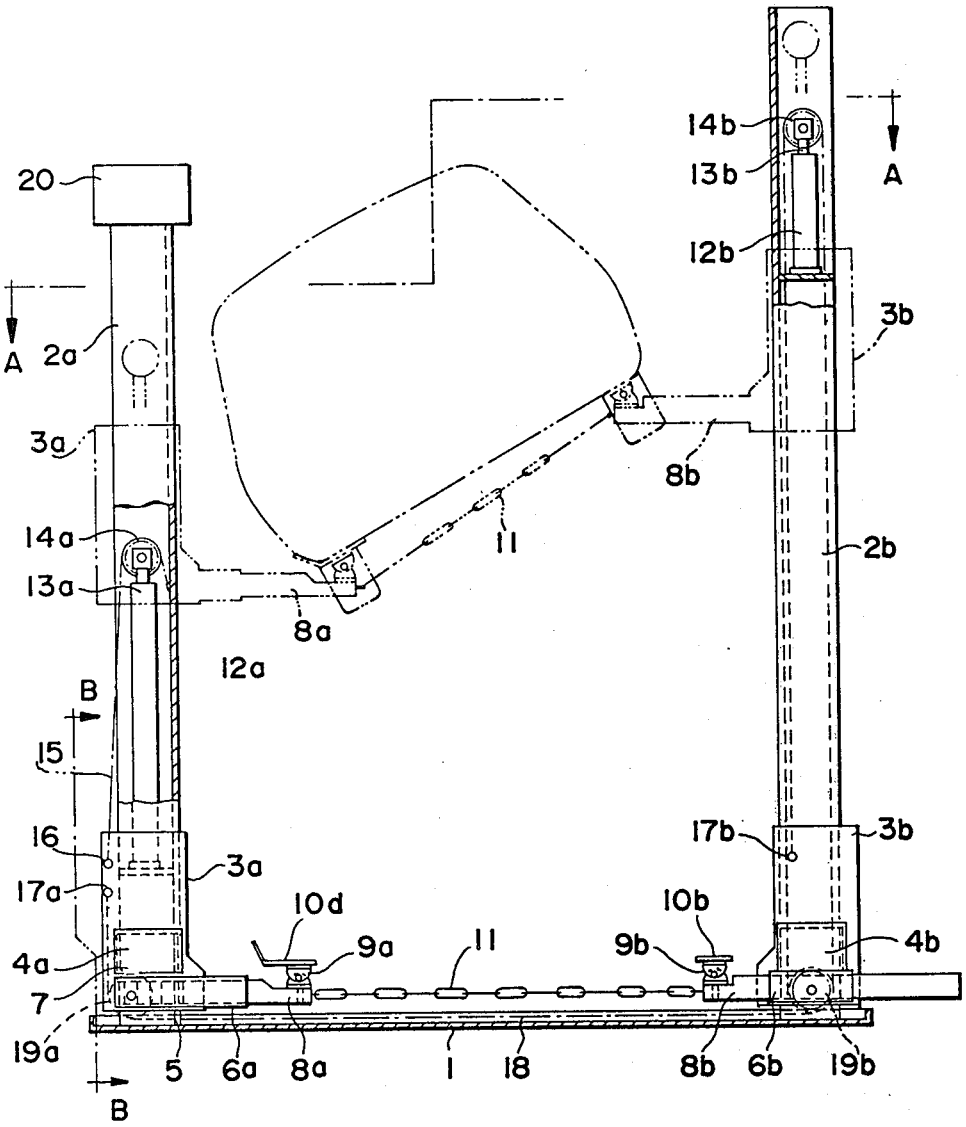
Figure 2:
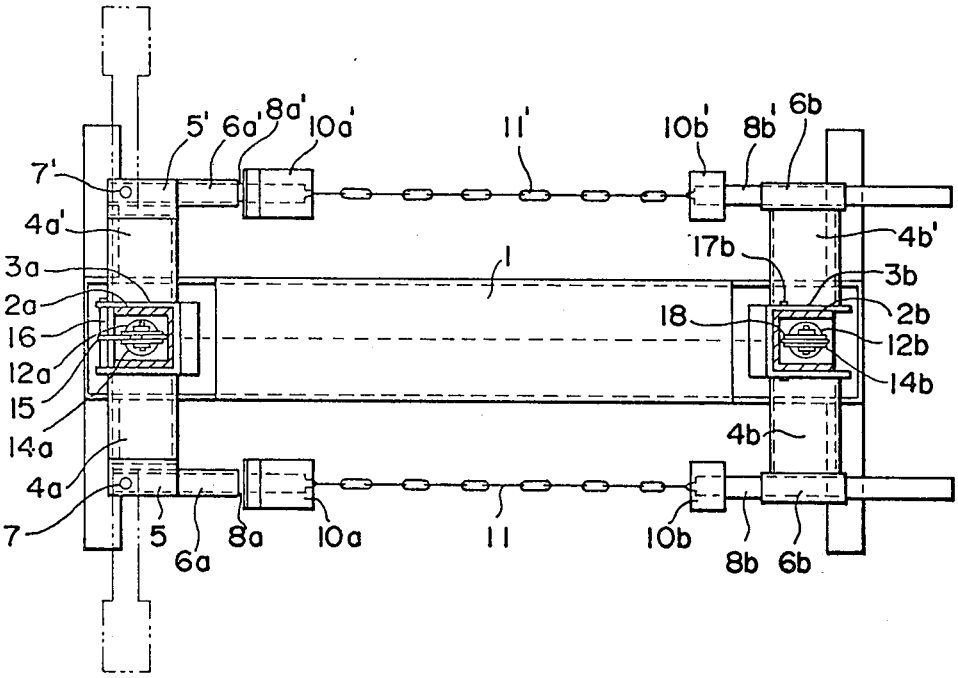
Figure 3:
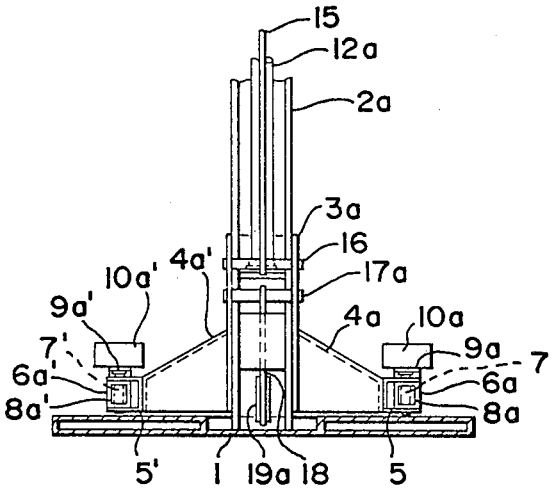

One of preferred embodiments of a two-masted lifting apparatus in accordance with the present invention will now be described in detail, by way of example, with reference to the accompanying drawings, in which:

FIG. 1 is a front view showing one embodiment of a two-masted lifting apparatus according to the invention, FIG. 2 is a sectional view of the same, when taken along the line A—A in FIG. 1, and FIG. 3 is a sectional view of the same, when taken along the line B—B in FIG. 1.

With particular reference to FIGS. 1 and 2, there is shown a base 1 on which two masts 2*a* and 2*b* of channel section are vertically mounted such that the connected portions of the channel-shaped masts 2*a* and 2*b* oppose each other. A carriage 3*a* or 3*b* of channel section is slidably mounted on each of the masts 2*a* and 2*b*.

Respectively secured to the front and the rear faces of the left-hand carriage 3*a* are two brackets 4*a* and 4*a'* to the outer ends of which bearing members 5 and 5' are secured. These two bearing members 5 and 5', as shown in FIG. 3, are of channel section and in parallel with each other. Each bearing member 5 or 5' has a vertical pin 7 adapted to pivotally support an end portion of a hollow sleeve 6*a* or 6*a'* of square section, into which an arm 8*a* or 8*a'* is slidably inserted to constitute a telescopic structure.

Each of these two arms 5 and 5' has a pin-block 9*a* on the upper surface of its free end portion so as to secure a step 10*a* or 10' thereon, whereby each step 10*a* or 10*a'* is rotatable with respect to the arm 5 or 5'.

Similarly, a bracket 4*b* or 4*b'* is firmly secured to the front or the rear face of the carriage 3*b* slidably mounted on the right-hand mast 2*b*. Each bracket 4*b* or 4*b'* has at its outer end a hollow sleeve 6*b* or 6*b'* of square section into which an arm 8*b* or 8*b'* is slidably inserted. Both arms 8*b* and 8*b'* inserted within the sleeves 6*b* and 6*b'* are in parallel with each other and have on the upper surfaces of their free end portions pin-blocks 9*b* and 9*b'* respectively for securing steps 10*b* and 10*b'* thereon. Between the two opposing steps 10*a*(10*a'*) and 10*b*(10*b'*), there is removably installed a chain 11 or 11' as shown in FIG. 2.

In order to move up or down the carriage 3*a* along the mast 2*a*, a lifting means 12*a* which utilizes, for example, fluid pressure such as oil pressure is vertically disposed within the mast 2*a* of channel section. A piston rod 13*a* of the lifting means 12*a* has a sprocket wheel 14*a* on its upper end. A chain 15, one end of which is secured to an appropriate portion 15*a* of the mast 2*a* and other end of which is also secured to a horizontal pin 16 anchored to the carriage 3*a*, extends around the sprocket wheel 14*a* of the piston rod 13*a*.

Similarly, within the right-hand mast 2*b* of channel section, a lifting means 12*b* of the fluid pressure type is vertically disposed; its piston rod 13*b* having a sprocket wheel 14*b* on the top thereof around which a chain 18 extends. This chain 18, one end of which is secured to a pin 17*a* mounted on the left-hand mast 2*a* and the other end of which is also secured to a horizontal pin 17*b* mounted on the right-hand carriage 2*b*, goes around a sprocket wheel 19*a* rotatably mounted on the bottom portion of the mast 2*a* and passes through the base 1. It further extends around another sprocket wheel 19*b* rotatably mounted on the bottom portion of the right-hand mast 2*b* and the sprocket wheel 14*b* mounted on the top of the piston rod 13*b* and reaches the horizontal pin 17*b* on the carriage 3*b*.

Both of the above described lifting means 12*a* and 12*b* of the fluid pressure type, being connected to a fluid pressure source 20 mounted on the top of the left-hand mast 2*a*, are actuated independently from each other.

When the foregoing descriptions in mind, attention will now be directed to the operation of the lifting apparatus of the present invention.

To begin with, both lifting means 12*a* and 12*b* are actuated to lower the carriages 3*a* and 3*b* along the masts 2*a* and 2*b* down to their ultimate bottom portions. A vehicle or the like to be inspected is then driven between the two masts 2a and 2b. Thereafter, sleeves 6a or 6a' pivotally mounted on the left-hand carriage 3a are suitably swung, and the length of arms 8a, 8a', 8b and 8b' slidably inserted within the sleeves is also suitably adjusted until all of the steps 10a, 10a', 10b and 10b' are brought into positive engagement with the most appropriate portions of the underside of the vehicle. Chains 11 and 11' are installed without any slack between 10a and 10b or between 10a' and 10b' respectively.

Next, only the left-hand lifting means 12a is actuated to raise its piston rod 13a so that the left-hand carriage 3a moves upward along the mast 2a. At the same moment, the right-hand carriage 3b associatively connected with the left-hand carriage 3a through a chain 18 moves up synchronously along the mast 2b. Thus, the vehicle supported by the four steps moves upward maintaining its original posture.

As soon as the vehicle has reached an appropriate position, the actuation of the left-hand lifting means 12a is stopped. Then, the right-hand lifting means 12b is actuated. At this moment, since the left-hand lifting means 12a is not working, only the right-hand lifting means 12b moves upward. The actuation of the right-hand lifting means 12b is continued until a desired inclination angle of the vehicle is obtained.

In this case, the distance between the two opposing steps 10a(10a') and 10b(10b') tends to expand, because only the right-hand carriage 3b moves upward. Each pair of the steps, however, are connected to each other by a chain 11 or 11' so that arms 8b or 8b' slidably inserted within the right-hand sleeves 6b or 6b' are dragged out of the sleeves toward the left-hand mast 2a; whereby the distance between the steps is kept constant.

Thus, according to the two-masted lifting apparatus of the invention, it becomes possible to incline a vehicle or the like at a desired angle without any fear of slippage of the vehicle.

What I claim is:

1. A two-masted lifting apparatus comprising:

a base means;

a pair of spaced upright masts disposed on said base means in opposing relation;

a carriage slidably mounted on each of said masts, a first driving means including means operatively connecting both of said carriages for synchronous movement of said carriages simultaneously along said masts, a supporting means on each of said carriages for supporting an object to be lifted, each of said supporting means including horizontally movable means each having a portion to accommodate a range of movement of adjustment toward or away from the respective associated mast of each of said supporting means, and means connecting said supporting means to maintain equi-distant movement of adjustment of said portions of said horizontally movable means between said carriages.

2. The device as set forth in claim 1 wherein said means for connecting said two opposing supporting means comprises a chain means.

3. A two-masted lifting apparatus according to claim 1 wherein said first and second driving means are disposed within said masts.

4. The device as set forth in claim 1 wherein said first and said second driving means comprise fluid pressure lifter means.

5. A two-masted lifting apparatus as set forth in claim 1 wherein said first driving means includes connecting means connecting said two carriages so that when said first driving means is actuated, both of said carriages are synchronously moved up and down along the masts.

6. The device as set forth in claim 5 wherein said means for connecting said two opposing supporting means is a chain means.

7. A two-masted lifting apparatus according to claim 5 wherein said first and second driving means are disposed within said masts.

8. The device as set forth in claim 5 wherein said first and second driving means comprise fluid pressure lifter means.

9. A two-masted lifting apparatus as set forth in claim 1 wherein each of said horizontally-movable means comprises a sleeve and an arm slidably inserted within said sleeve and including an extending arm portion and a support step on said extending arm portion.

10. A two-masted lifting apparatus according to claim 1 wherein each of said supporting means comprises a first and a second pair of parallel supporting means portions.

11. A two-masted lifting apparatus according to claim 5 wherein each of said supporting means comprises a first and a second pair of parallel supporting means portions.

12. The device as set forth in claim 9 wherein said support step includes horizontally-pivotal movement means for each of said portions supporting each of said steps.

* * * * *

UNITED STATES PATENT OFFICE

CERTIFICATE OF CORRECTION

Patent No. 4,058,293 Dated November 15, 1977

Inventor(s) Tamotsu Kameda

It is certified that error appears in the above-identified patent and that said Letters Patent are hereby corrected as shown below:

Add: "Assignee: Yasui Sangyo Co., Ltd., Shizuoka-ken, Japan".

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*